United States Patent [19]

Taddicken et al.

[11] 4,296,696

[45] Oct. 27, 1981

[54] DEVICE FOR PRODUCING SEWING SEAM PATTERNS OF STITCH GROUPS

[75] Inventors: Hermann Taddicken, Schwäbisch Gmünd-Unterbettringen; Wolfgang Sachs, Mögglingen, both of Fed. Rep. of Germany

[73] Assignee: Eisele Apparate-und Gerätebau GmbH, Fed. Rep. of Germany

[21] Appl. No.: 182,777

[22] Filed: Aug. 29, 1980

[30] Foreign Application Priority Data

Sep. 5, 1979 [DE] Fed. Rep. of Germany ..... 2935763

[51] Int. Cl.[3] ..... D05B 3/06

[52] U.S. Cl. ..... 112/70; 112/121.14

[58] Field of Search ..... 112/70, 65, 121.14, 112/73, 76

[56] References Cited

U.S. PATENT DOCUMENTS 2,864,327 12/1958 Cole et al. ..... 112/121.14
3,738,292 6/1973 Hintzen et al. ..... 112/65
4,131,074 12/1978 Riss ..... 112/121.14
4,134,346 1/1979 Bolldorf et al. ..... 112/70

*Primary Examiner*—H. Hampton Hunter
*Attorney, Agent, or Firm*—McGlew and Tuttle

[57] ABSTRACT

A device for producing sewing seam patterns of stitch groups in a work, for example buttonholes, including a holding mechanism for displacing the work intermittently to perform individual sewing operations, and a sewing machine equipped with a work clamping mechanism which is displaceable relative to a needle bar performing a swinging motion, and which engages the work in the area of the seam pattern to be sewn, comprising, a guide arrangement connected to the sewing machine for displacing the sewing machine parallel to the direction of displacement of the clamping mechanism, and a drive mechanism connected to the guide assembly and controlled by movement of the clamping mechanism through which cyclic motions in conformity with stitch formation are imparted to the sewing machine along a distance corresponding to the length of a seam pattern to be formed, which motions are opposite in direction to those of the clamping mechanism.

13 Claims, 7 Drawing Figures

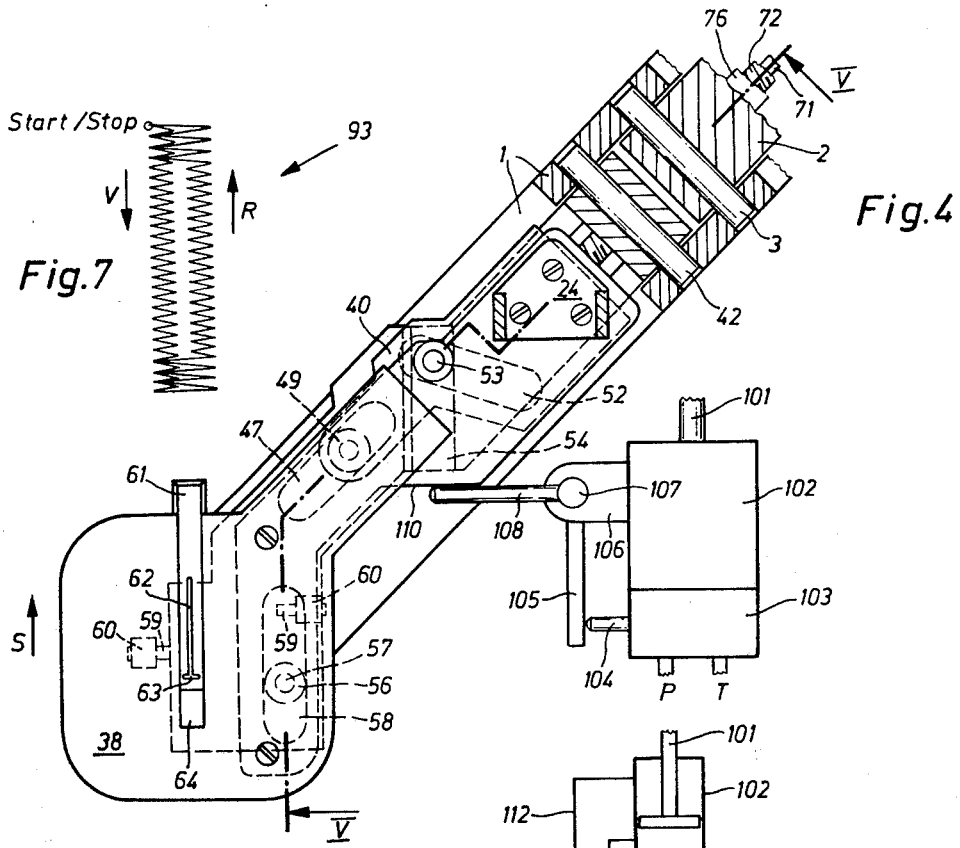
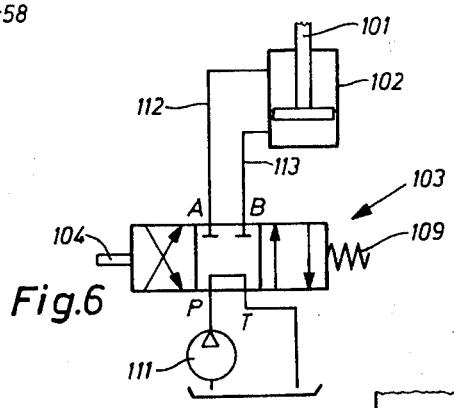
Fig.6
Fig.5
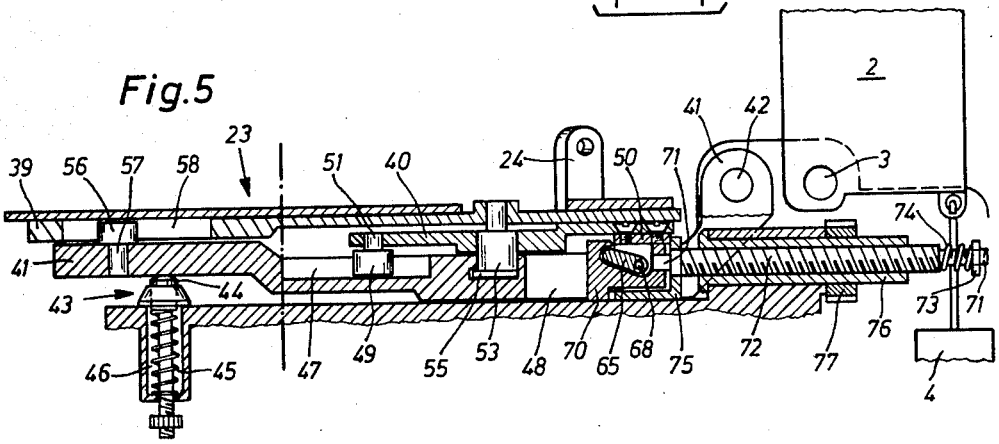

DEVICE FOR PRODUCING SEWING SEAM PATTERNS OF STITCH GROUPS

FIELD AND BACKGROUND OF THE INVENTION

The present invention relates in general to sewing machines and in particular to a new and useful device for producing sewing seam patterns of stitch groups for example button holes comprising a guide assembly for carrying a sewing machine which moves the sewing machine cyclically in a direction of stitch formation according to the motion of a displaceable clamping mechanism of the sewing machine.

In a device according to German Pat. No. 1,230,296, for producing a plurality of spaced buttonholes in a workpiece, such as a front part of a shirt, using a buttonhole sewing machine comprising a work clamping mechanism displaceable through a distance corresponding to the length of the buttonhole, a workpiece holder is provided by which, during the interval between two sewing operations, the workpiece is displaced through the interspace between two buttonholes. The workpiece or work holder is equipped with two clamps which are so spaced from each other that the work can be clamped in the area of the button tape, at its leading and trailing edges. The work clamps are mounted on the holder for pivoting toward and away from each other and they are operatively connected, through a linkage, to a part of the sewing machine stopping device, which is moved, before the start and after the termination of each individual sewing operation, in such a way that prior to the start of the sewing operation, the clamps are moved toward each other to slacken the work, so that the work may be freely moved relative to the stopped work holder in the area of the buttonhole to be sewn. Upon termination of a sewing operation, the clamps are moved away from each other to stretch the work to the proper extension between two buttonholes in the longitudinal direction of the button tape, for further displacement by the work holder.

Because of the slackening in the longitudinal direction, however, the work may very easily deform, due to its elasticity. With tricot, knitted fabrics and other highly elastic materials, this deformation is very extensive and not only causes puckering in the areas reinforced by sewing but also, since the folded edge of the work "springs up", a deviation of the fold edge from a straight line. With fancy, especially checkered materials, this is particularly conspicuous and therefore unacceptable. It is true that the so-called springing up of a folded button tape might be prevented to a large extent by ironing, however, further costs are incurred with such an additional operation, which should be avoided.

SUMMARY OF THE INVENTION

The objective of the present invention is to prevent the work to be sewn from deforming between and during the individual sewing operations.

To this end the invention is directed to a device for keeping the work in the holding mechanism in a uniform stretched state both during the displacement from one sewing area to the other and during the individual sewing operations, and to dispense with a displacement of the work during the individual sewing operations, so that the work can be continually kept under control over its entire length.

Accordingly an object of the present invention is to provide a device for producing sewing seam patterns of stitch groups, for example buttonholes, comprising a holding mechanism displacing the work intermittently to perform individual sewing operations, and a sewing machine equipped with a work clamping mechanism which is displaceable relative to a needle bar performing a swinging motion, and engages the work in the zone of the seam pattern to be sewn, comprising, guide means connected to the sewing machine for displacement of the sewing machine parallel to the direction of displacement of the clamping mechanism and a drive mechanism connected to the guide means and controlled by motion of the clamping mechanism through which cyclic motions in conformity with stitch formation are imparted to the sewing machine along a distance corresponding to the length of a seam pattern to be formed, which motions are opposite in direction to those of the clamping mechanism.

A further object of the present invention is to provide a method of producing sewing seam patterns of stitch groups comprising, intermittently displacing a workpiece to receive seam patterns in a workpiece feed direction, clamping the workpiece in an area thereof to receive a seam pattern, moving the clamped workpiece area from an initial position past a sewing needle and looper of a sewing machine, in a first seam forming direction for a length of one side of a seam pattern to be formed, to form one side of the seam pattern, moving the sewing machine in a direction opposite to the first seam forming direction for the length of the one side to return the workpiece area to its initial position, unclamping the workpiece area, and intermittently displacing the workpiece by a distance equal to a spacing between seam patterns to be formed.

A still further object of the invention is to provide a device for producing sewing seam patterns, particularly button holes, which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

In the Drawings:

FIG. 4 is a top plan view of the clamping mechanism;

FIG. 5 is a sectional view taken along the line V—V of FIG. 4;

FIG. 6 is a circuit diagram of the device controlling the drive mechanism of the sewing machine; and FIG. 7 is an enlarged diagrammatical illustration of the buttonhole.

DETAILED DESCRIPTION OF PREFERRED EMBODIMENT

Figure 1:
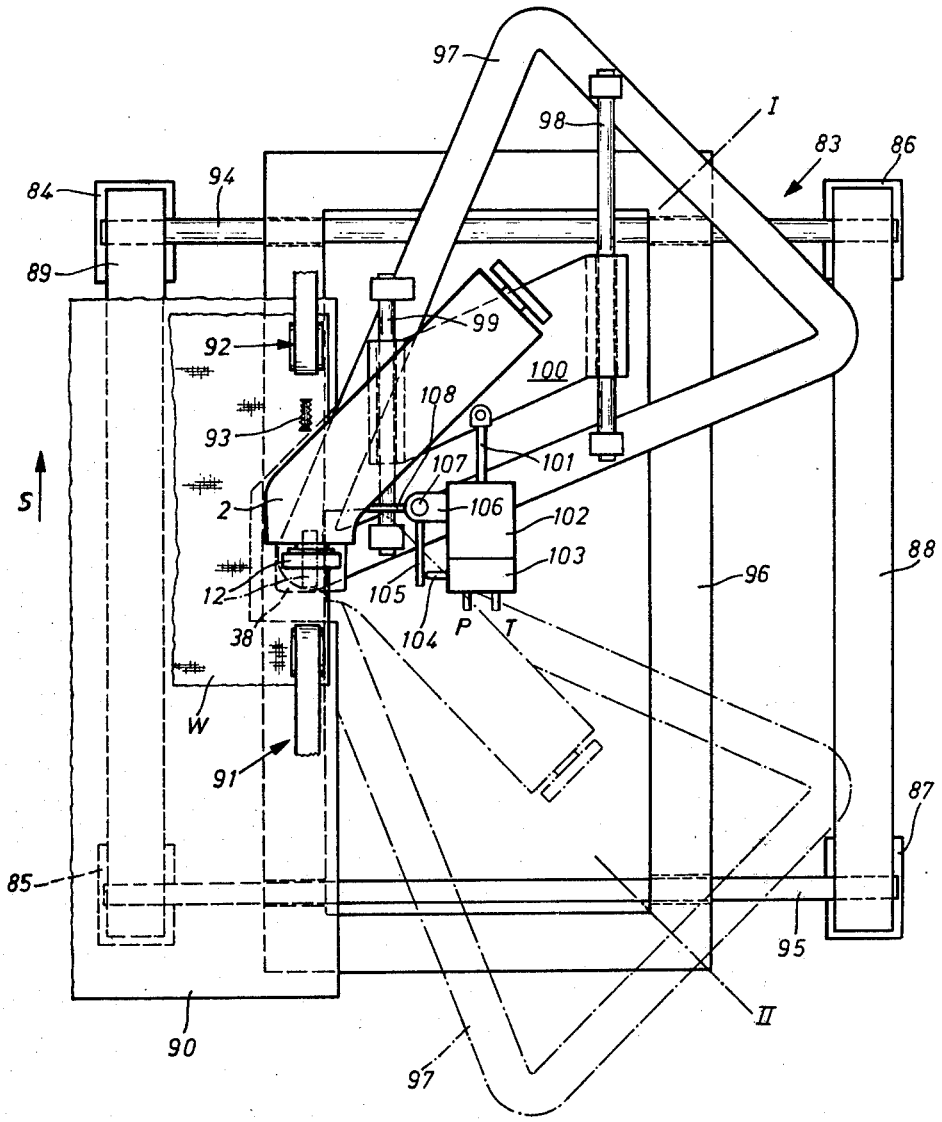
FIG. 1 is a simplified top plan view of the device and a buttonhole sewing machine.

One embodiment of the invention is described in detail in the following with reference to the drawings showing the device in connection with a buttonhole sewing machine.

The sewing machine is shown in the drawings is a buttonhole sewing machine designed for group stitching and comprising a base part 1 and an arm 2 pivoted thereto on a journal 3. To move arm 2 from its sewing position into a rest position remote from the sewing position, the arm is connected, at a location lateral of journal 3 to the spring loaded armature of an electromagnet 4. The arm may additionally be arrested in its two end positions by means of suitable stops.

Within base part 1, a main shaft 5 is mounted carrying a belt pulley 6 which is driven by an electric motor (not shown), adapted to stop with the needle of the sewing machine in a predetermined (up or down) position. On the other end of main shaft 5, a crank 7 is provided by which a needle bar 11, carrying a thread-guiding needle 10, is driven through a link 8 and an intermediate member 9. Needle 10 pierces the work from below upwardly and cooperates with a rotary hook or looper 12 which is mounted on the front side of arm 2.

To drive rotary hook 12, a belt pulley 13 is secured to main shaft 5, by which rotary motion is imparted through a cog belt 14, another pulley 15, a shaft 16 mounted in arm 2, and bevel gears 17, to a vertically extending shaft 18. Shaft 18 is operatively connected, through other bevel gears 19, to the shaft 20 of rotary hook 12 which is thus driven through the described transmission train, to execute two revolutions per needle motion cycle.

In the shown embodiment, the sewing machine is equipped with a work clamping mechanism 21 which is intended to receive the work and substantially comprises an upper clamping part 22 and a lower clamping part 23.

Figure 2:
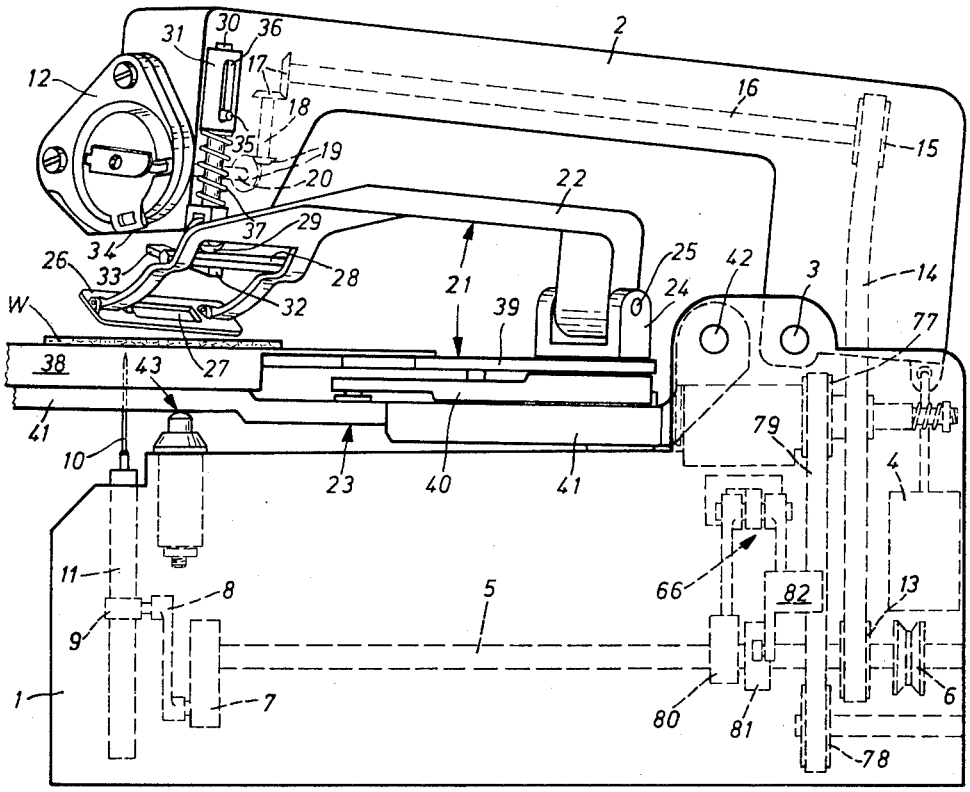
FIG. 2 is an enlarged side elevational view of the buttonhole sewing machine.

Upper clamping part 22 is supported in a bracket 24 secured to lower clamping part 23, and is pivotable about a horizontal axis 25 extending obliquely relative to main shaft 5. At the front end of upper clamping part 22, a clamping frame 26 is mounted by which the work is pressed against lower clamping part 23 and which is provided with an aperture 27 for the passage of needle 10 and of a buttonhole cutting blade (not shown). The front end of upper clamping part 22 is further provided with a presser bar 28 extending parallel to the work feed direction and engaged from above by a pressure roller 29 running thereon. Pressure roller 29 is mounted for free rotation on the lower end of a guide bar 30 which is forked on that end and is slidably received in a lug 31 of arm 2. The lower end of guide bar 30 is further provided with a stop 32 which engages presser bar 28 from below, and with an angle piece 33 which bears against the underside of arm 2 serving as an abutment 34. As shown in FIG. 2, guide bar 30 carries a pin 35 extending perpendicularly to the longitudinal axis of the bar and sliding within an oblong slot 36 of lug 31, which extends parallel to the longitudinal axis of the bar, so that the longitudinal displacement of guide bar 30 is thereby limited. A spring 37 provided between lug 31 and the lower end of guide bar 30 retains upper clamping part 22 permanently in its bottom position.

Lower clamping bar 23 is assembled of a cover plate 38, a workpiece supporting plate 39, an intermediate plate 40, and a base plate 41, with a base plate 41 being pivoted to base part 1 by means of a journal 42 and resting, in the stitch formation zone, against a spring loaded support 43 (FIGS. 2 and 5). Support 43 comprises a bolt 44 surrounded by a spring 45 which can be compressed within a cylindrical cavity 46 of base part 1. A nut provided on its lower end limits the upward displacement of bolt 44.

Base plate 41 of lower clamping part 23 is provided with two slideways 47 and 48, which extend parallel to main shaft 5 of the machine and in which a roller 49 and a sliding member 50 are displaceably engaged. Both sliding member 50 and roller 49, which is rotatable about a vertical pin 51, are firmly connected to intermediate plate 40 of lower clamping part 23, so that intermediate plate 40 is guided in base plate 41.

Intermediate plate 40 (FIGS. 3 and 4) is provided with an oblique slideway 52 which extends at an oblique angle to slideways 47 and 48 and through which a pin 53 is passed protruding by its lower end into an oblique slideway 54 which is provided in base plate 41 and again extends at an oblique angle relative to the mentioned oblique slideway 52 of intermediate plate 40. Due to this arrangement of two oblique slideways 52, 54 in intermediate plate 40 and base plate 41, respectively, as intermediate plate 40 is displaced along slideways 47 and 48, pin 53 is shifted within oblique slideway 54 of base plate 41 so that work supporting plate 39, which is secured to the upper end of pin 53, is moved in this direction, i.e. parallel to oblique slideway 54 of base plate 41. To prevent work supporting plate 39 or pin 53 from being lifted, the lower end of pin 53 is provided with a lateral flange sliding inside a groove 55 of slideway 54 of base plate 41. To ensure an exactly parallel guidance of work supporting plate 39, a guide roller 56 is provided in the front end area of base plate 41. Roller 56 is supported on a pin 57 which is fixed to the base plate 1 and engages into a slot 58 provided in work supporting plate 39 and extending parallel to oblique slideway 54 of base plate 41.

For receiving the workpiece, workpiece supporting plate 39 is rigidly connected to cover plate 38 and bears against two supporting rollers 60 which are mounted on the front end portion of base plate 41 for rotation about horizontal axis 59, with one of the rollers 60 supporting plate 39 directly and the other indirectly, through cover plate 38. The front end portion of base plate 41 is further provided with an insert, which may be termed a needle plate 61, having an oblong slot 62 for the buttonhole cutting blade (not shown) and a needle hole 63 for the passage of needle 10. Needle plate 61 protrudes into a recess 64 of plate 38 covering work supporting plate 39.

The sliding member 50 secured to intermediate plate 40 and having a substantially U-shaped cross-section with outwardly angled legs engaging base plate 41 from below, serves the purpose of receiving a shaped part 65 which forms a component part of a coupling 67 provided between a stepping gear 66 (FIG. 2) and the clamping mechanism 21. Shaped part 65 is mounted for pivoting about a pin 68 received in sliding member 50, and is surrounded by a counterpart 70 which belongs to coupling 67, has a corresponding recess 69 and is secured to a rod 71. Rod 71 extends substantially parallel to main shaft 5 of the machine, through a threaded spindle 72 designed as a hollow shaft. At its other end, rod 71 is provided with an adjustable abutment 73 for a spring 74 which is inserted between the abutment and the end of threaded spindle 72 and exerts a pressure by which shaped part 65 is held in engagement with outer part 70. This makes sliding member 50 apply under pressure against an angled member 75 which is connected to threaded spindle 72. Spindle 72 is encircled by a threaded sleeve 76 which is mounted for rotation in base part 1 but axially fixed, and is moved back and forth in accordance with the direction in which sleeve 76 is rotated. Threaded sleeve 76 carries a belt pulley 77 which cooperates, through a cog belt 79 passed around a return pulley 78, with the stepping gear 66. Stepping gear 66 further comprises two eccentrics 80, 81 which are mounted on main shaft 5 and by which both a feed motion and a spreading or clamping motion is imparted to a belt tongs 82, whereby the motion derived from feed eccentric 80 is transmitted, through cog belt 79, as an intermittent rotary motion is threaded sleeve 76. Additional details on this structure can be found in U.S. Pat. No. 3,824,938 issued July 23, 1974 to Tölle.

The buttonhole sewing machine of FIG. 2 is accommodated in a frame 83 (FIG. 1) comprising four posts 84 to 87 connected by cross-pieces 88 and 89. Secured to crosspiece 89 is a table plate 90 against which the work W is pressed by means of lowerable, spring loaded pressure belts 91 and 92 and on which it is displaced between the individual sewing operations, in every instance through a distance corresponding to the spacing of two buttonholes 93. In the stitch forming area, table plate 90 is provided with an aperture. The top sides of table plate 90 and cover plate 38 are flush with each other and form a supporting surface for the work. The two pressure belts 91 and 92 constitute a holding and feeding device. In FIG. 1, pressure belt 92 is shown relatively far behind the stitch forming area, to clearly show buttonhole 93. In practice, however, pressure belt 92 engages the work close behind needle plate 61.

Guide bars 94 and 95 are secured to posts 84, 86 and 85, 87, respectively, on which a frame 96 is supported for displacement perpendicularly to the feed direction S (FIG. 1) so that the buttonhole sewing machine can be displaced from its sewing position shown in FIG. 1 into an off position. The machine can be secured in these two positions by arresting mechanisms.

A triangular carrier 97 is mounted on frame 96 for pivoting about a vertical axis between working positions I (solid line) and II (dot dash line) in which it can be arrested. The pivotal axis of carrier 97 coincides with the longitudinal axis of the needle. Carrier 97 bears against frame 96, and supports two spaced slide bars 98 and 99 which are secured thereto and extend in the feed direction S, and on which a saddle 100 carrying the buttonhole sewing machine is guided for displacement.

Figure 3:
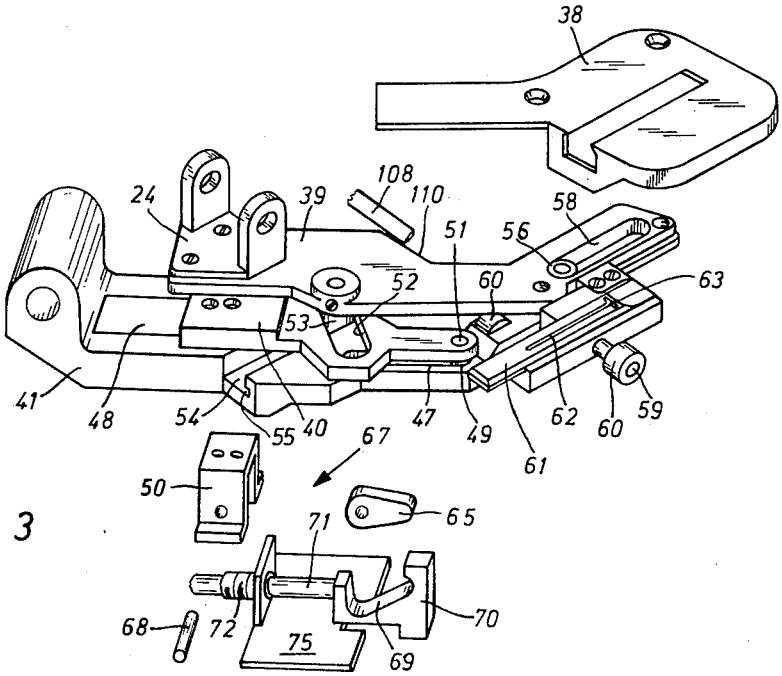
FIG. 3 is a perspective view of the clamping mechanism, with some elements shown apart.

Saddle 100 is connected to the piston rod 101 of a hydraulic cylinder 102 which operates as a drive for displacing the saddle with the sewing machine and is secured to carrier 97. Hydraulic cylinder 102 is controlled through a direction valve 103 having four ports and three distinct positions and equipped with an actuating pin 104 which is connected to the slide of the valve. Pin 104 cooperates with a lever arm 105 which is secured to a shaft 107 mounted in an extension 106 of the cylinder housing. Further secured to shaft 107 is another lever arm 108 operating as a feeler. Under the action of spring 109 (FIG. 6) urging the slide of control valve 103 into a first switch position, feeler 108 applies against a contact surface 110 of work supporting plate 39 (FIGS. 3 and 4).

In this first position of control valve 103, induced by spring 109, pressure is applied to hydraulic cylinder 102 by a pump 111 through pump connection P, operating connection A, and line 112. From the other cylinder space, hydraulic pil flows through a line 133, connection P and tank connection T back to the tank. In the central of mid-position (bypass position), the fluid returns to the tank substantially pressureless. In the third position in which the slide of control valve 103 is actuated through feeler 108, shaft 107, lever arm 105, and pin 104 against the action of spring 109, pressure is applied to hydraulic cylinder 102 by the pump 111 through connections P and B and line 113. The oil from the first cylinder space returns to the tank through line 112 and connections A and T.

To make a row of buttonholes in a sequence of individual sewing operations, the device operates as follows:

Assuming that carrier 97 and the buttonhole sewing machine are in sewing position (FIG. 1) for buttonholes arranged in a line parallel to the work edge (thus in the feed direction S), that pressure belts 91 and 92, arm 2 of the sewing machine, and clamping frame 26 of the upper clamping part 22, through stop 32 engaging pressure part 28 from below, are lifted, and that work W with a single fold in the button tape area is placed on table plate 90 and cover plate 38 of lower clamping bar 23, and brought in alignment. Control valve 103 is held in its mid-position by clamping mechanism 21, i.e, by way of contact surface 110, feeler 108, shaft 107 , lever arm 105, and actuating pin 104, against the action of spring 109. In this mid-position, the hydraulic fluid flows from pump 111 through pump connection P and tank connection T back to the tank and does not produce any effect.

While putting the workpiece in place, lower clamping bar 23 occupies a substantially horizontal position and base plate 41 rests against bolt 44 forming support 43. Spring 45 may be considered relieved and pin 35, with spring 37 also relieved, applies against the lower end of oblong slot 36.

Pressure belts 91, 92 intended to hold the workpiece down are lowered so that they apply against the workpiece and press it along its entire length into contact with the supporting surface. Only a space for applying clamping frame 26 is left free.

To move arm 2 from its rest position shown in FIG. 2 to its sewing position, magnet 4 is energized so that arm 2 executes a pivotal motion about journal 3. Upper clamping part 22 is thereby pivoted about its axis 25 and moves downwardly in synchronism with arm 2. As soon as clamping frame 26 applies against the work, arm 2 in its further motion is displaced relative to guide bar 30, since spring 37 is weaker than spring 45, pressure roller 29 applies against presser bar 28, and spring 37 is compressed. Guide bar 30 is displaced upwardly relative to lug 31 until pin 35 securing the bar against rotation reaches the upper portion of oblong slot 36. Angle piece 33 (FIG. 2) secured to the lower end of guide bar 30 then engages stop 34 which is formed by the underside of arm 2. Arm 2 and upper clamping part 22 now form a rigid unit so that during the further downward motion of arm 2, spring 45 is compressed until arm 2 attains its sewing position determined by the end position of magnet 4. During the pivotal motion of arm 2, lower clamping part 23 has been pivoted through a corresponding angular distance about journal 42. However, since journal 42 is relatively remote from the stitch forming area, this angular distance is relatively small so that at the end of its pivotal motion, lower clamping part 23 still occupies a substantially horizonal position. Upon fixing arm 2 in its sewing position, the mutual relations of needle 10, its stroke, and rotary hook 12 are secured. Since lower clamping bar 23 also carries needle plate 61, this plate has been pushed more or less downwardly, in accordance with the thickness of the workpiece. A variation of the workpiece thickness is thus compensated for by the vertical position of the needle plate, or the lower clamping part supporting the plate, so that the distance between the upper surface of the work at rotary hook 12, or the needle eye in a certain position, remains constant. Consequently, the length of the needle thread loop forming between the needle eye and the upper surface of the work also remains constant, independently of the work thickness. This insures permanently uniform conditions of stitch formation, which are completely independent of the work thickness and make the sewing operation reliable.

To form the seam, for example, of a buttonhole 93, FIG. 7, needle 10, which penetrates the workpiece W from below upwardly, and rotary hook 12 are driven by the shown drive mechanism. Pressure roller 29 rolls on presser bar 28 so that a clamping pressure is produced by compressed spring 45 between upper clamping part 22 and lower clamping part 23. An intermittent rotary motion is transmitted from the two eccentrics 80, 81 of the stepping gear through belt tongs 82 and cog belt 79 to belt pulley 77 which is firmly fitted on threaded sleeve 76. Threaded spindle 72 which is secured against rotation is thereby displaced in accordance with the direction of rotation of threaded sleeve 76, and moves member 75 connected thereto in the axial direction of the spindle. Member 75 applies against the front face of sliding member 50 and pushes it in the longitudinal direction. This imparts a longitudinal motion to intermediate plate 40 which is guided by roller 49 and sliding member 50 in slideways 47, 48 so that pin 53 is displaced within oblique slideway 52 of intermediate plate 40 and, at the same time, moved along oblique slideway 54 provided in base plate 41. Workpiece supporting plate 39 which is firmly connected to pin 53 is thereby displaced as predetermined by the extension of oblique slideway 54, and is guided in this motion in addition by guide roller 56 which is carried on base plate 41 and protrudes into guide slot 58 of plate 39.

The sewing of buttonholes starts with one or more piercing strokes by needle 10 at the start/stop point (FIG. 7). During periods in which needle 10 is in a position outside the work, intermediate plate 40, to which a longitudinal intermittent motion is imparted, is moved relative to the base part 1 of the machine in the direction of journal 42. At the same time, work supporting plate 39 is moved in the way described above, in the direction of arrow S, FIGS. 1 and 4. Under the action of spring 109, effective through actuating pin 104, lever arm 103, and shaft 107, feeler 108 follows contact surface 110 of work supporting plate 39 in the clockwise direction, so that the slide of control valve 103 is displaced from its mid-position into the first switch position and the hydraulic oil is directed through pump connection P, operating connection A and line 112 into the first cylinder space of hydraulic cylinder 102. During this time, the second cylinder space of hydraulic cylinder 102 is connected through line 113 and connections B and T to the tank. In this switch position of control valve 103, piston rod 101 moves in the direction opposite to that of work supporting plate 39, i.e. in the direction of arrow V, FIG. 7, which is opposite to the direction of arrow S. This motion of piston rod 101 displaces saddle 100, to which the buttonhole sewing machine is secured and which is supported on slide bar 98 and 99. Through a definite distance into a position in which the next piercing stroke of needle 10 is provided.

With the displacement of the sewing machine as a unit, workpiece clamping mechanism 21 returns, in relation to the workpiece which is locally fixed to table plate 90 by pressure belts 91 and 92 and clamped in the sewing area by clamping mechanism 21, to its position occupied at the start of the sewing operation. At the same time, through contact surface 110 of work supporting plate 38, feeler 108, shaft 107, lever arm 105, and actuating pin 104, the slide of control valve 103 is returned, against the action of spring 109, into its mid-position (zero or bypass position).

After the first head of buttonhole 93 is sewn, the motion to be transmitted to cog belt 79 through belt tongs 82 is reversed by appropriate means (not shown), so that threaded sleeve 76 is now driven in the opposite direction of rotation. At the same time, th bight of needle bar 11 is changed, by other known means (not shown), to sew the first barring stitches.

Now, up to the end of the sewing operation, motion steps in the direction opposite to arrow S and corresponding to the stitch position are imparted to work supporting plate 39 through shaped part 65, counterpart 70, and intermediate plate 40. Thereby, at each step of motion, the slide of control valve 103 is displaced, through contact surface 110 of work supporting plate 39, feeler 108, shaft 107, lever arm 105, and actuating pin 104, and against the action of spring 109 , into its third switch position in which pump connection P is connected through operating connection B and line 113 to the second cylinder space, and tank connection T is connected through operating connection A and line 112 to the first cylinder space of hydraulic cylinder 102. In this switch position, saddle 100 carrying the sewing machine is displaced on slide bars 98, 99 by piston rod 101 in the direction of arrow S, FIGS. 1 and 4, or arrow R, FIG. 7, through a definite distance with a position in which the next piercing stroke of needle 10 is provided.

With the displacement of the buttonhole sewing machine as a unit, clamping mechanism 21 returns after each motion step into its starting position. Work or workpiece W thus remains in place during the sewing operation along its entire length, except for the in fact unimportant motion through the length of a stitch in the area of the buttonhole to be sewn, while the sewing machine executes a cyclic motion, in accordance with the stitch pattern and depending on the relative motions between clamping mechanism 21 and the other parts of the machine, along a path corresponding to the length of the buttonhole, first in the direction V and then in the direction R.

In this way, the first barring stitches of buttonhole 93 are made, then the second bead, the second barring stitches, and finally one or more securing stitches at the start/stop point. During sewing of the securing stitches, the slide of control valve 103 is in its mid-position. At the end of the sewing operation, the buttonhole sewing machine is stopped in the lowermost position of the needle, the buttonhole is slit and the threads are cut.

Upon stopping the buttonhole sewing machine and deenergizing electromagnet 4, arm 2 returns to its rest position under the action of spring 37. During this motion, spring 45 expands first, clamping mechanism 21 performs a pivotal motion about journal 42, and lower clamping part 22 is moved from its sewing position into its standby position. Further, spring 37 expands until pin 35 applies to the lower end of oblong slot 36. Clamping frame 26 of upper clamping part 22 remains applied to the work up to this instant. Then, clamping part 22 is taken along by further upwardly moving arm 2, due to the engagement from below of presser bar 28 by stop 32, until arm 2 reaches its rest position shown in FIG. 2 in which clamping frame 26 is slightly lifted from work supporting plate 39. This lifting is dimensioned to permit an easy inserting and removing, or a further transportation, as well as alignment of the work.

By means of pressure belts 91, 92 which are intermittently drivable by suitable means (not shown) and by which the work is held in pressure contact with the supporting cylinders, work W is then advanced in the direction of S, FIGS. 1 and 4, through a distance corresponding to the spacing of the buttonholes, and, upon lowering arm 2 and upper clamping part 22 again, another individual sewing operation producing the next buttonhole as described above may start. As soon as all the buttonholes of a front part of a shift, for example, are sewn, pressure belts 91, 92 are lifted, the work is removed, the next work W is put in place and aligned, and the described cycle may re-commence.

The fact that during the sewing operation the work is not displaced is a remarkable advantage permitting the use of this device for sewing, with a fully satisfactory result, of buttonholes extending both parallel and transversely to the work edge. To sew transverse buttonholes, it suffices to pivot the carrier 97 supporting the sewing machine and the drive mechanism thereof, from its position I, FIG. 1, in which parallel buttonholes are sewn, into its position II, and lock it in this position.

It is finally to be noted that for maintenance, the buttonhole sewing machine may be shifted from its sewing position according to FIG. 1, into an off position in the direction of posts 86, 87, since frame 96 supporting carrier 97 and the sewing machine, is mounted on guide bars 94, 95 which are secured to frame 83.

While a specific embodiment of the invention has been shown and described in detail to illustrate the application of the principles of the invention, it will be understood that the invention may be embodied otherwise without departing from such principles.

What is claimed is:

1. A device for producing sewing seam patterns of stitch groups in a workpiece, for example buttonholes, including a holding mechanism for displacing the work intermittently to perform individual sewing operations, and a sewing machine equipped with a work clamping mechanism which is displaceable relative to a needle bar performing a swinging motion, and which engages the work in the area of the seam pattern to be sewn, comprising, guide means connected to the sewing machine for displacement of the sewing machine parallel to the direction of displacement of the clamping mechanism, and a drive mechanism connected to the guide means and controlled by motion of the clamping mechanism through which cyclic motions in conformity with stitch formation are imparted to the sewing machine along a distance corresponding to the length of a seam pattern to be formed, which motions are opposite in direction to those of the clamping mechanism.

2. A device according to claim 1, wherein the clamping mechanism is associated with a feeler of a valve device controlling the drive mechanism.

3. A device according to claim 1, wherein the sewing machine is supported on guides (98, 99) extending parallel to the direction of displacement of the clamping mechanism, a feeler (108) projecting into the path of motion of the clamping mechanism and connected to an actuating lever (104) of a control valve (103), the sewing machine being hinged to a working piston (101) of a hydraulic cylinder (102) controlled by the control valve.

4. A device according to claim 3, wherein the sewing machine and the guides (98, 99) are supported on a carrier (97) which can be pivoted about a vertical axis into, and locked in, two working positions (I, II) angularly offset relative to each other by about 90°.

5. A device according to claim 4, wherein the carrier (97) is displaceable between a sewing position and an off position of the sewing machine away from the sewing position.

6. A device for sewing seam patterns of stitch groups in workpieces comprising:

a sewing machine having a needle and looper with reciprocating drive means connected thereto for sewing a seam side;

clamping means connected to said sewing machine for clamping a workpiece in an area thereof to receive a seam pattern;

a clamping means driver connected to said clamping means for moving said clamping means with workpiece area clamped therein past the needle and looper for a seam side length to sew one side of a seam pattern;

guide means connected to said sewing machine for carrying said sewing machine in a direction opposite a direction of movement of said clamping means; and a guide means driver connected to said guide means and activatable by said clamping means for moving said sewing machine in a direction opposite from a direction of movement of said clamping means.

7. A device according to claim 6, wherein said guide means driver comprises a cylinder having a piston with piston rod connected to said guide means, a valve connected to said cylinder for moving said piston rod in a first and opposite direction, and an actuator arm abutting said clamping means and connected to said valve for activating said valve.

8. A device according to claim 6, wherein said guide means comprises a saddle connected to said sewing machine for carrying said sewing machine, at least one sliding bar slidably receiving said saddle and a carrier connected to said sliding bar.

9. A device according to claim 8, further including a frame for pivotally supporting said carrier for moving said sewing machine between a first position and a second position at an angle to said first position.

10. A device according to claim 9, wherein a pivot point of said carrier on said frame corresponds to an area of reciprocation of said needle.

11. A device according to claim 9, including at least one transverse guide bar extending at an angle to said slide bar for slidably receiving said frame for movement of said sewing machine from a sewing position to a position spaced from said sewing position.

12. A method of producing sewing seam patterns as stitch groups comprising:

intermittently displacing a workpiece to receive seam patterns in a workpiece feed direction;

clamping the workpiece in an area thereof to receive a seam pattern;

moving the clamped workpiece area from an initial position past a sewing needle and looper of a sewing machine, in a first seam forming direction for a length of one side of a seam pattern to be formed, to form the one side of the seam pattern;

moving the sewing machine in a direction opposite the first seam forming direction for the length of the one side to return the workpiece area to its initial position;

unclamping the workpiece area; and intermittently displacing the workpiece by a distance equal to a spacing between adjacent seam patterns to be formed.

13. A method according to claim 12, including moving the clamping workpiece area in a second seam forming direction for forming a second side of a seam pattern to be formed, and moving the sewing machine in a direction opposite said second seam forming direction.

* * * * *